US008974182B2

(12) United States Patent
Boyer et al.

(10) Patent No.: US 8,974,182 B2
(45) Date of Patent: Mar. 10, 2015

(54) TURBINE BUCKET WITH A CORE CAVITY HAVING A CONTOURED TURN

(75) Inventors: Bradley Taylor Boyer, Greenville, SC (US); Thomas Robbins Tipton, Greer, SC (US)

(73) Assignee: General Electric Company, Schenectady, NY (US)

( * ) Notice: Subject to any disclaimer, the term of this patent is extended or adjusted under 35 U.S.C. 154(b) by 520 days.

(21) Appl. No.: 13/409,355

(22) Filed: Mar. 1, 2012

(65) Prior Publication Data

US 2013/0230407 A1 Sep. 5, 2013

(51) Int. Cl.
*F01D 5/18* (2006.01)

(52) U.S. Cl.
CPC ..... *F01D 5/186* (2013.01); *F05D 2250/185* (2013.01); *F05D 2250/71* (2013.01)
USPC ..... 416/97 R

(58) Field of Classification Search
CPC ..... F01D 5/18; F01D 5/186; F01D 25/12; F05D 2260/202; F05D 2260/22141
USPC ..... 416/97 R
See application file for complete search history.

(56) References Cited

U.S. PATENT DOCUMENTS

| | | | | |
|---|---|---|---|---|
| 5,340,278 | A | 8/1994 | Magowan | |
| 5,344,283 | A | 9/1994 | Magowan et al. | |
| 5,382,135 | A | 1/1995 | Green | |
| 5,848,876 | A | 12/1998 | Tomita | |
| 5,915,923 | A * | 6/1999 | Tomita et al. | 416/96 R |
| 6,062,817 | A | 5/2000 | Danowski et al. | |
| 6,071,075 | A | 6/2000 | Tomita et al. | |
| 6,190,130 | B1 | 2/2001 | Fukue et al. | |
| 6,341,939 | B1 | 1/2002 | Lee | |
| 6,390,774 | B1 | 5/2002 | Lewis et al. | |
| 6,481,967 | B2 | 11/2002 | Tomita et al. | |
| 7,147,439 | B2 | 12/2006 | Jacala et al. | |
| 7,255,536 | B2 | 8/2007 | Cunha et al. | |
| 7,416,391 | B2 | 8/2008 | Veltre et al. | |
| 7,497,661 | B2 | 3/2009 | Boury et al. | |
| 7,597,536 | B1 | 10/2009 | Liang | |
| 7,766,606 | B2 | 8/2010 | Liang | |
| 8,047,787 | B1 * | 11/2011 | Liang | 416/97 R |
| 8,177,507 | B2 * | 5/2012 | Pietraszkiewicz et al. | 416/97 R |
| 8,465,255 | B2 * | 6/2013 | Hada et al. | 416/97 R |
| 2007/0189896 | A1 | 8/2007 | Itzel et al. | |
| 2010/0129213 | A1 | 5/2010 | Strohl et al. | |
| 2011/0123310 | A1 | 5/2011 | Beattie et al. | |
| 2011/0223004 | A1 | 9/2011 | Lacy et al. | |

FOREIGN PATENT DOCUMENTS

EP 1128024 A2 8/2001

OTHER PUBLICATIONS

Search Report and Written Opinion from EP Application No. 13157492.3 dated May 27, 2013.
U.S. Appl. No. 12/878,075, filed Sep. 9, 2010, Boyer.
U.S. Appl. No. 12,972,835, filed Dec. 20, 2010, Harris, Jr., et al.

* cited by examiner

*Primary Examiner* — Ninh H Nguyen
(74) *Attorney, Agent, or Firm* — Sutherland Asbill & Brennan LLP

(57) ABSTRACT

The present application thus provides a turbine bucket. The turbine bucket may include a platform, an airfoil extending from the platform at an intersection thereof, and a core cavity extending within the platform and the airfoil. The core cavity may include a contoured turn about the intersection so as to reduce thermal stress therein.

17 Claims, 5 Drawing Sheets

TURBINE BUCKET WITH A CORE CAVITY HAVING A CONTOURED TURN

TECHNICAL FIELD

The present application and the resultant patent relate generally to gas turbine engines and more particularly relate to a gas turbine engine with a turbine bucket having an airfoil with a core cavity having a contoured turn about a platform so as to reduce stress therein due to thermal expansion.

BACKGROUND OF THE INVENTION

Known gas turbine engines generally include rows of circumferentially spaced nozzles and buckets. A turbine bucket generally includes an airfoil having a pressure side and a suction side and extending radially upward from a platform. A hollow shank portion may extend radially downward from the platform and may include a dovetail and the like so as to secure the turbine bucket to a turbine wheel. The platform generally defines an inner boundary for the hot combustion gases flowing through a gas path. As such, the platform may be an area of high stress concentration due to the hot combustion gases and the mechanical loading thereon.

More specifically, there is often a large amount of thermally induced strain at the intersection of an airfoil and a platform. This thermally induced strain may be due to the temperature differential between the airfoil and the platform. The thermally induced strain may combine with geometric discontinuities in the region so as to create areas of very high stress that may limit component lifetime. To date, these issues have been addressed by attempting to keep geometric discontinuities such as root turns, internal ribs, and the like, away from the intersection. Further, attempts have been made to control the temperature about the intersection. Temperature control, however, generally requires additional cooling flows at the expense of overall engine efficiency. These known cooling arrangements, however, thus may be difficult and expensive to manufacture and may require the use of an excessive amount of air or other types of cooling flows.

There is thus a desire for an improved turbine bucket for use with a gas turbine engine. Preferably such a turbine bucket may limit the stresses at the intersection of an airfoil and a platform without excessive manufacturing and operating costs and without excessive cooling medium losses for efficient operation and an extended component lifetime.

SUMMARY OF THE INVENTION

The present application and the resultant patent thus provide a turbine bucket. The turbine bucket may include a platform, an airfoil extending from the platform at an intersection thereof, and a core cavity extending within the platform and the airfoil. The core cavity may include a contoured turn about the intersection so as to reduce thermal stress therein.

The present application and the resultant patent further provide a turbine bucket. The turbine bucket may include a platform, an airfoil extending from the platform at an intersection thereof, and a trailing edge core cavity extending within the platform and the airfoil. The trailing edge core cavity may include a cooling conduit with a contoured turn about the intersection so as to reduce thermal stress therein.

The present application and the resultant patent further provide a turbine bucket. The turbine bucket may include a platform, an airfoil extending from the platform at an intersection thereof, a trailing edge core cavity extending within the platform and the airfoil, and a cooling medium flowing therethrough. The trailing edge core cavity may include a contoured turn about the intersection with an area of reduced thickness so as to reduce thermal stresses therein.

These and other features and improvement of the present application and the resultant patent will become apparent to one of ordinary skill in the art upon review of the following detailed description when taken in conjunction with the several drawings and the appended claims.

DETAILED DESCRIPTION

Figure 1:
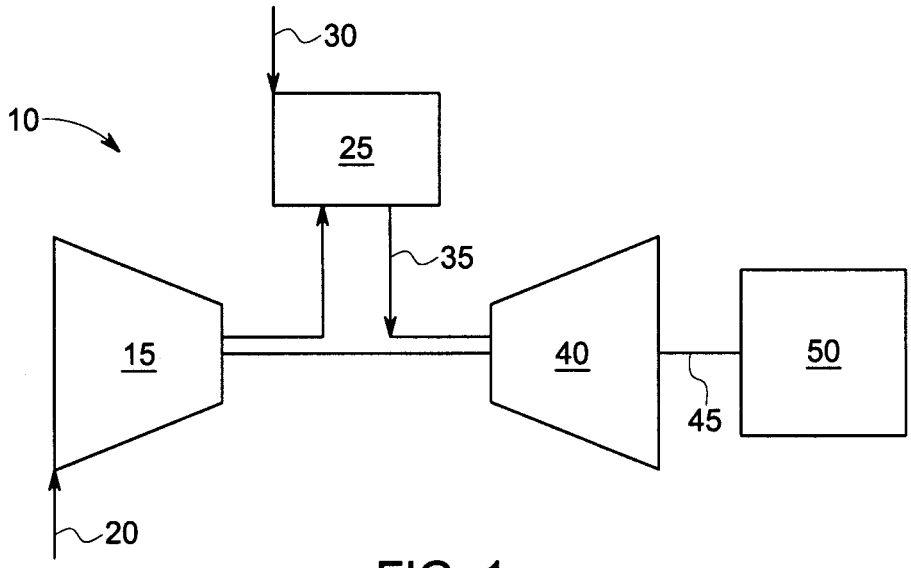
FIG. 1 is a schematic diagram of a gas turbine engine with a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
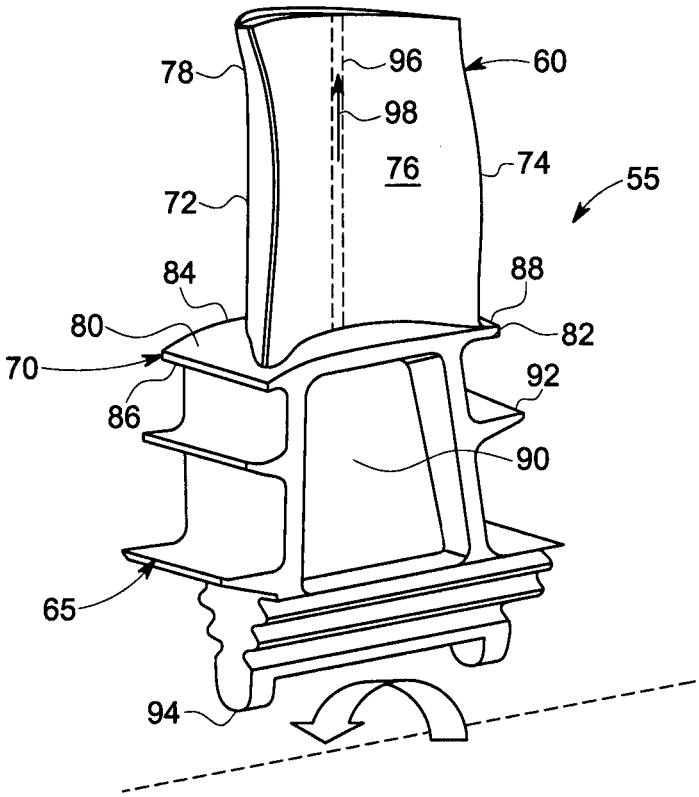
FIG. 2 is a perspective view of a known turbine bucket.
Figure 3:
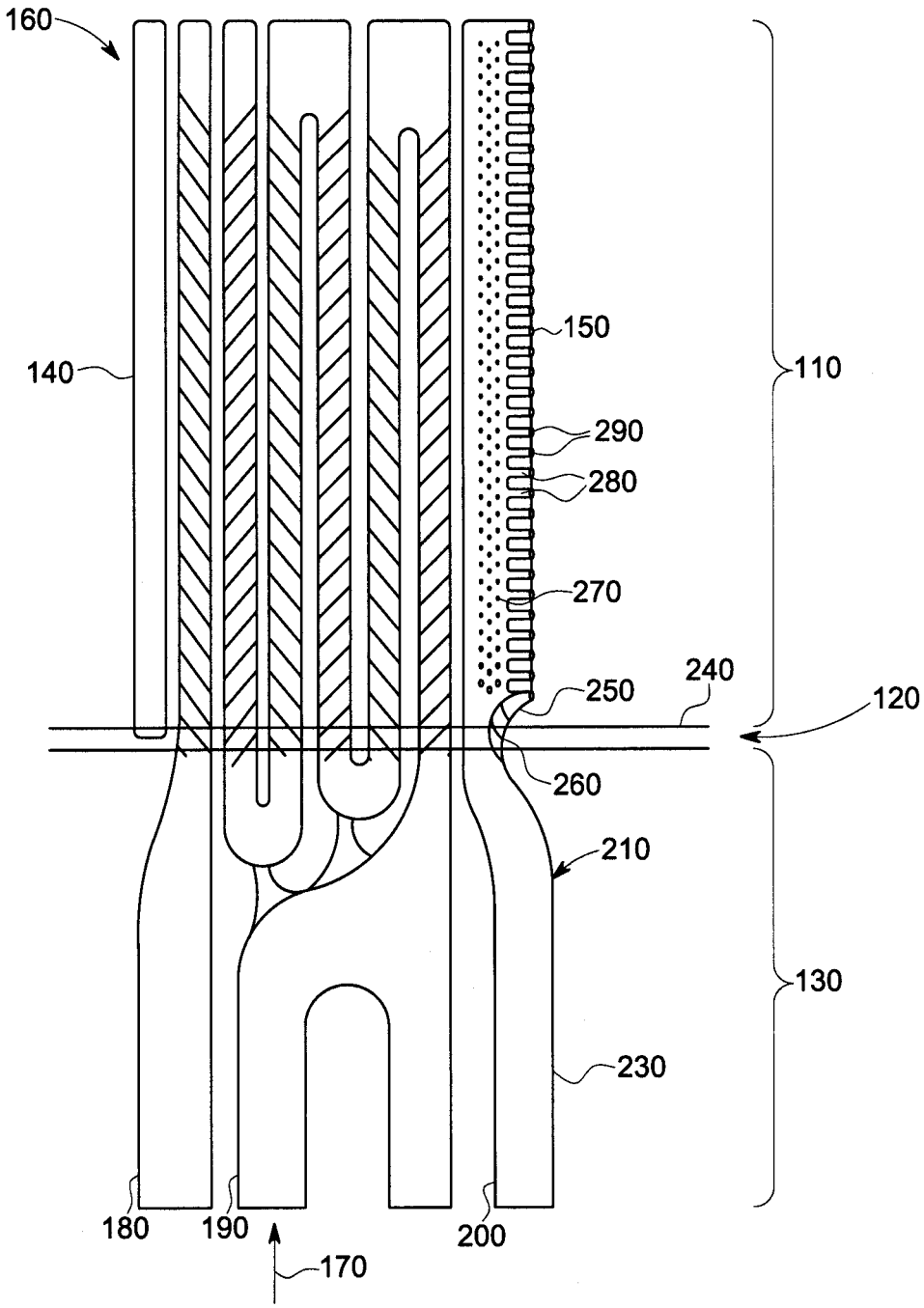
FIG. 3 is a side plan view of a core body of a turbine bucket as may be described herein.
Figure 4:
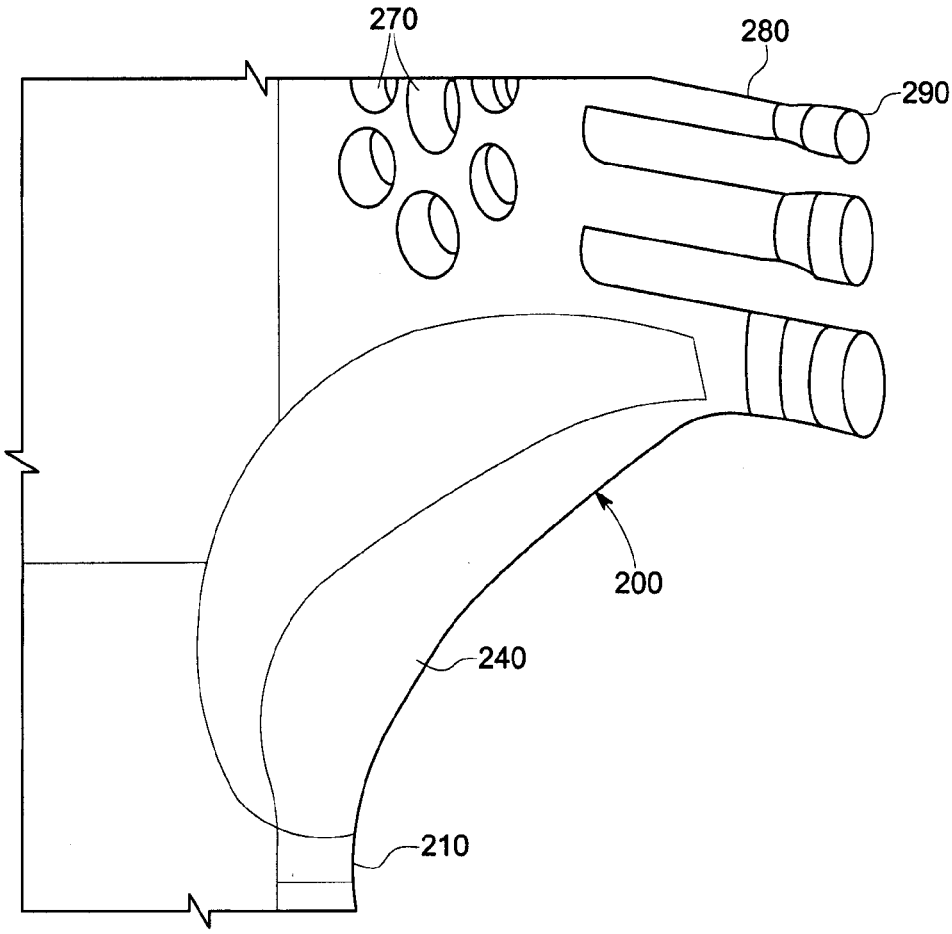
FIG. 4 is an expanded view of a trailing edge core cavity as may be described herein.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35.

The shank portion 65 may extend radially downward from the platform 70 such that the platform 70 generally defines an interface between the airfoil 60 and the shank portion 65. The shank portion 65 may include a shank cavity 90 therein. The shank portion 65 also may include one or more angle wings 92 and a root structure 94 such as a dovetail and the like. The root structure 94 may be configured to secure the turbine bucket 55 to the shaft 45. Other components and other configurations may be used herein.

The turbine bucket 55 may include one or more cooling circuits 96 extending therethrough for flowing a cooling medium 98 such as air from the compressor 15 or from another source. The cooling circuits 96 and the cooling medium 98 may circulate at least through portions of the airfoil 60, the shank portion 65, and the platform 70 in any order, direction, or route. Many different types of cooling circuits and cooling mediums may be used herein. Other components and other configurations also may be used herein.

FIGS. 3-6 show an example of a turbine bucket 100 as may be described herein. The turbine bucket 100 may include an airfoil 110, a platform 120, and a shank portion 130. Similar to that described above, the airfoil 110 extends radially upward from the platform 120 and includes a leading edge 140 and a trailing edge 150. Within the turbine bucket 100 there may be a number of core cavities 160. The core cavities 160 supply a cooling medium 170 to the components thereof so as to cool the overall turbine bucket 100. The cooling medium 170 may be air, steam, and the like from any source. In this example, a leading edge core cavity 180, a central core cavity 190, and a trailing edge core cavity 200 are shown. A number of the core cavities 160 may be used herein. Other components and other configurations may be used.

Generally described, the trailing edge core cavity 200 may be in the form of a cooling conduit 210. The cooling conduit 210 may define a cooling passage 220 extending therethrough for the cooling medium 170. The cooling conduit 210 may extend from a cooling input 230 about the shank portion 130 towards the platform 120 and the airfoil 110. At about an intersection 240 between the platform 120 and the airfoil 110, the cooling conduit 210 may expand at a contoured turn 250. The contoured turn 250 thus may have an area of an increased edge radius 260. The cooling passage 220 therein likewise expands through the contoured turn 250 so as to reduce the thickness of the material thereabout. Specifically, the contoured turn 250 may have an area of a reduced wall thickness 255.

Figure 5:
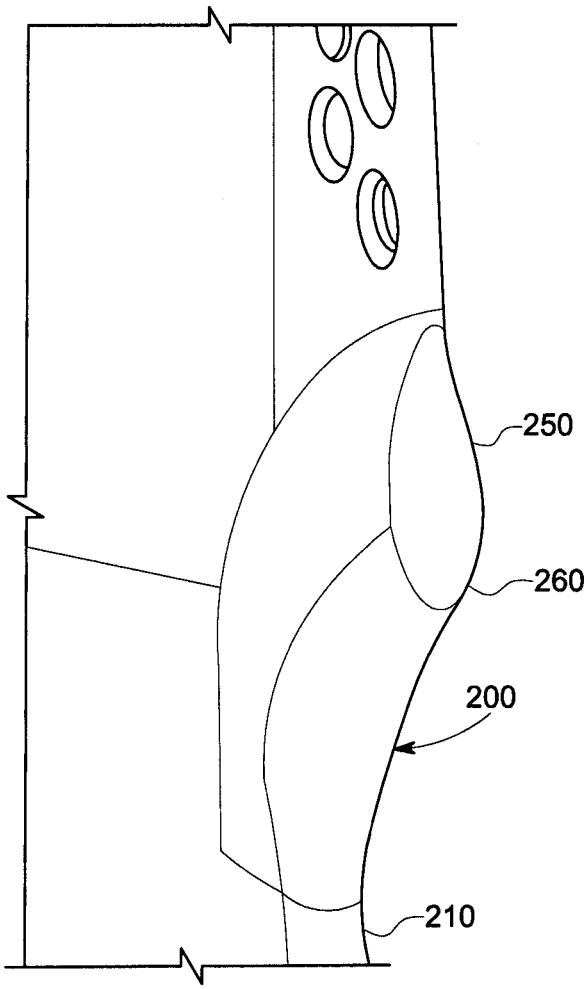
FIG. 5 is a sectional view of a portion of the trailing edge core cavity of FIG. 4.
Figure 6:
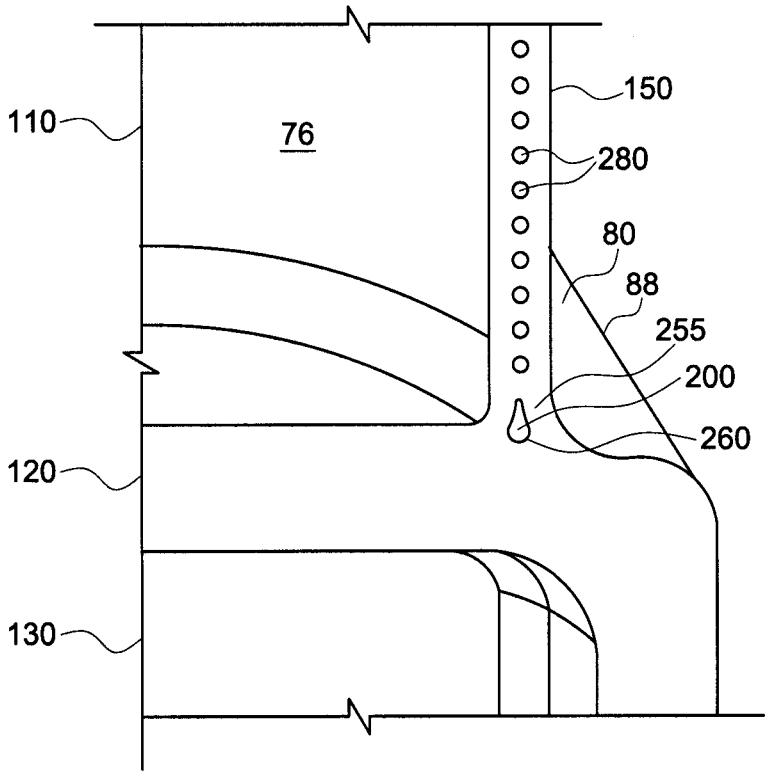
FIG. 6 is a further sectional view of a portion of the trailing edge core cavity of FIG. 4.

The cooling conduit 210 continues through a series of pins 270 or other types of turbulators through the airfoil 110. Likewise, a number of cooling tubes 280 leading to a number of cooling holes 290 may extend towards the trailing edge 150 so as to provide film cooling to the airfoil 110. FIG. 5 shows the contoured turn 250 of the cooling conduit 210 about the intersection 240. Likewise, FIG. 6 shows the expanded cooling section 220 about the intersection 240. Other components and other configurations also may be used herein.

The use of the contoured turn 250 in the cooling conduit 210 about the intersection 240 between the airfoil 110 and the platform 120 reduces the stiffness at the intersection 240 via the reduced wall thickness 255. The reduced stiffness thus reduces stress therein due to temperature differences between the airfoil 110 and the platform 120. The reduced wall thickness 255 about the contoured turn 250 also allows for the larger edge radius 260. The larger edge radius 260 also reduces the peak stresses therein. Reducing stress at the intersection 240 should provide increased overall lifetime with reduced maintenance and maintenance costs. Moreover, the reduced wall thickness 255 and increased edge radius 260 may make the overall trailing edge core cavity 200 stronger so as to prevent core breakage during manufacture and thus decreasing overall casting costs. Further, excessive amounts of the cooling medium 170 may not be required herein. The overall impact of thermal expansion to the turbine bucket 100 thus may be reduced.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine bucket, comprising:

a platform;

an airfoil extending from the platform at an intersection thereof, the airfoil comprising a leading edge and a trailing edge; and a core cavity extending within the platform and the airfoil, the core cavity comprising a cooling conduit with a cooling passage extending therethrough;

wherein the core cavity comprises a contoured turn about the intersection so as to reduce thermal stress therein, such that the cooling conduit curves towards the trailing edge and exits therethrough; and wherein the cooling passage increases in cross-sectional area between the platform and the trailing edge.

2. The turbine bucket of claim 1, wherein the core cavity comprises a trailing edge core cavity.

3. The turbine bucket of claim 1, further comprising a plurality of core cavities.

4. The turbine bucket of claim 1, wherein the core cavity comprises a cooling medium therein.

5. The turbine bucket of claim 1, wherein the cooling passage increases in radial size about the contoured turn.

6. The turbine bucket of claim 1, wherein the cooling conduit comprises an area of reduced wall thickness about the contoured turn.

7. The turbine bucket of claim 1, wherein the cooling conduit comprises an increased edge radius about the contoured turn.

8. The turbine bucket of claim 1, wherein the core cavity comprises a plurality of pins and a plurality of cooling holes downstream of the intersection.

9. The turbine bucket of claim 1, wherein the core cavity extends from a cooling input to a plurality of cooling holes.

10. The turbine bucket of claim 1, wherein the contoured turn extends in a direction of a trailing edge of the airfoil.

11. A turbine bucket, comprising:

a platform;

an airfoil with a leading edge and a trailing edge extending from the platform at an intersection thereof; and a trailing edge core cavity extending within the platform to the trailing edge of the airfoil;

wherein the trailing edge core cavity comprises a cooling conduit with a contoured turn about the intersection so as to reduce thermal stress therein, the cooling conduit comprising a cooling passage extending therethrough, the cooling passage increasing in cross-sectional area between the platform and the trailing edge.

12. The turbine bucket of claim 11, wherein the cooling conduit comprises a cooling medium therein.

13. The turbine bucket of claim 11, wherein the cooling passage increases in radial size about the contoured turn.

14. The turbine bucket of claim 11, wherein the cooling conduit comprises an area of reduced wall thickness about the contoured turn.

15. The turbine bucket of claim 11, wherein the cooling conduit comprises an increased edge radius about the contoured turn.

16. The turbine bucket of claim 11, wherein the cooling conduit extends from a cooling input to a plurality of cooling holes.

17. A turbine bucket, comprising:

a platform;

an airfoil with a leading edge and a trailing edge extending from the platform at an intersection thereof;

a trailing edge core cavity extending within the platform to the trailing edge of the airfoil, the trailing edge core cavity comprising a cooling conduit with a cooling passage extending therethrough; and a cooling medium flowing through the cooling passage;

wherein the trailing edge core cavity comprises a contoured turn about the intersection with an area of reduced thickness so as to reduce thermal stresses therein;

the cooling conduit curves towards the trailing edge and exits therethrough; and the cooling passage increases in cross-sectional area about the contoured turn.

* * * * *